US006872128B1

(12) United States Patent
Pham et al.

(10) Patent No.: US 6,872,128 B1
(45) Date of Patent: Mar. 29, 2005

(54) SYSTEM, METHOD AND APPARATUS FOR APPLYING LIQUID TO A CMP POLISHING PAD

(75) Inventors: Xuyen Pham, Fremont, CA (US); Ren Zhou, Fremont, CA (US); Wen-Chiang Tu, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/676,388

(22) Filed: Sep. 30, 2003

(51) Int. Cl.[7] ..... B24B 1/00
(52) U.S. Cl. ..... 451/60; 451/56
(58) Field of Search ..... 451/60, 54, 56, 451/57

(56) References Cited

U.S. PATENT DOCUMENTS 5,679,063 A * 10/1997 Kimura et al. ..... 451/287
5,716,264 A * 2/1998 Kimura et al. ..... 451/443
5,997,392 A * 12/1999 Chamberlin et al. ..... 451/446
6,149,508 A * 11/2000 Vanell et al. ..... 451/72
6,338,669 B1 * 1/2002 Togawa et al. ..... 451/36
6,506,098 B1 * 1/2003 Ho et al. ..... 451/36
6,669,538 B2 * 12/2003 Li et al. ..... 451/56
6,702,651 B2 * 3/2004 Tolles ..... 451/41
2002/0022440 A1 * 2/2002 Kunugi ..... 451/60
2002/0023715 A1 * 2/2002 Kimura et al. ..... 156/345
2003/0027505 A1 * 2/2003 Withers et al. ..... 451/60

* cited by examiner

*Primary Examiner*—David B. Thomas
(74) *Attorney, Agent, or Firm*—Martine, Penilla & Gencarella

(57) ABSTRACT

A system and method of delivering a liquid to a CMP polishing pad includes supplying the liquid to a nozzle, the nozzle being oriented toward a polishing surface of the CMP polishing pad. The liquid flows at a rate of less than or equal to about 100 cc per minute. A pressurized carrier gas is also supplied to the nozzle. The liquid is substantially evenly sprayed from the nozzle onto the CMP polishing pad.

23 Claims, 9 Drawing Sheets

SYSTEM, METHOD AND APPARATUS FOR APPLYING LIQUID TO A CMP POLISHING PAD

BACKGROUND OF THE INVENTION

1. Field of the Invention

The present invention relates generally to chemical-mechanical planarization (CMP) systems, and more particularly, to methods and systems for applying one or more liquids to the CMP polishing pad.

2. Description of the Related Art

Semiconductor devices are typically formed on semiconductor substrates by forming multiple layers, one over another, to create multi-level structures. Because the multiple layers are formed over one another, a surface topography of the wafer can become irregular. An uncorrected irregularity can increase with subsequent layers. Chemical mechanical planarization (CMP) is a fabrication process used to planarize the surface of a semiconductor wafer so as to remove the topographical irregularities. CMP can also be used to perform additional fabrication processes including polishing, buffing, cleaning, etching, and the like. CMP can also include cleaning, buffing, polishing, planarizing, and otherwise processing substrates used in such applications as flat panel displays, hard disks, and the like.

In general, CMP processes include holding and rotating of a substrate against a preparation surface (i.e., the surface of a polishing pad) under a controlled pressure. Typical CMP apparatus include linear belt processing systems in which a continuous loop belt having a preparation surface is supported between two or more drums or rollers. The drums move the belt through a rotary path presenting a flat preparation surface against which the substrate is applied. Typically, the substrate is supported and rotated by a carrier (i.e., polishing head) and a polishing platen may be located on the underside of the belt. The platen provides a stable surface over which the belt travels, and the substrate is applied to the preparation surface of the belt against the stable surface provided by the platen.

A CMP apparatus can also include rotary CMP processing tools having a circular pad configuration for the preparation surface, orbital CMP processing tools similar to the circular CMP processing tool, sub-aperture CMP processing tools, and other CMP processing tools and systems providing multiple configurations that, in general, utilize friction to planarize, polish, buff, clean, or otherwise process the surface of a substrate such as a semiconductor wafer having integrated circuits or other structures fabricated thereon.

CMP processing typically includes the use of one or more and even varying combinations of abrasives, chemistries, rinsing or cleaning fluids, and the like to maximize effective use of friction for substrate preparation. Abrasives are often suspended in an aqueous solution, known as slurry, and deposited on the preparation surface. In some configurations, abrasives are provided as a part of the preparation surface and are known as fixed abrasive configurations.

FIG. 1A shows a typical linear belt CMP processing system 10. The linear belt CMP processing system 10 includes a wafer 12 applied against a linear processing belt 14. The wafer 12 is attached to a carrier 16 and can rotate the wafer 12 and to apply the wafer 12 against the linear processing belt 14 with a force 18. A platen 22 can provide a stable and secure surface against which the wafer 12 and linear processing belt 14 are supported. Linear processing belt 14 is positioned on and around two drums 20 providing support and rotation to linear processing belt 14. A single point slurry dispensing apparatus 26 dispenses slurry 24 "upstream" from wafer 12 so that the belt 14 can carry the slurry 24 to the wafer 12.

FIG. 1B shows an alternative slurry dispensing system. The alternative slurry dispensing system includes a slurry manifold 30, which is shown in an overhead view of a linear belt CMP processing system 10'. The slurry manifold 30 (i.e., a slurry bar) drips slurry through multiple dispensing outlets 32 across the width of the linear processing belt 14, upstream from wafer 12. One advantage of the slurry manifold 30 is that slurry can be dispensed across an entire width of preparation surface, or varying widths of a preparation surface depending on the number and spacing of slurry dispensing outlets 32 utilized, ensuring a complete coverage for multiple sizes of substrates.

One disadvantage to prior art slurry dispensing systems of either the single point or slurry manifold configurations is that the slurry is typically dispensed at flow rates of 100–200 cc/minute. As the slurry is an aqueous solution, slower flow rates (i.e., less than about 100 cc/minute) can allow for the solution to separate and/or not be distributed evenly across the slurry bar. Another disadvantage is that the slurry may only be dispensed from one or more slurry dispensing outlets and the droplets of slurry are dropped on the preparation surface at relative few locations. As a result, the slurry is not evenly applied across the width of the preparation surface.

Slurry and other process chemistries can also be very expensive. As a result, a higher process chemistry flow rates can equate to a higher CMP operating cost. In many CMP operations a slurry flow rate of less than about 100 cc/minute or less can provide equivalent results as a slurry flow rate of 200 cc/minute or more. However, the typical process chemistry dispensing systems cannot accurately and effectively dispense process chemistries at flow rates less than about 100 cc/minute. Excess process chemistries can also create an excessive waste byproduct stream. The excessive waste byproduct stream can further increase the operating cost due to the disposal and or recycling cost associated with the waste stream. What is needed is a system and method for evenly applying slurry and other process chemistries to the CMP preparation surface, at flow rates of about 100 cc/minute or less.

Another problem with conventional CMP systems is that CMP byproducts can build-up in the CMP preparation surface. By way of example, as the slurry and the preparation surface remove material from the wafer, the removed material and slurry are transported away from the wafer surface by pockets and crevices (i.e., pores) in the preparation surface. Often these pores can be relatively deep within the preparation surface. The CMP byproducts can contact or be re-deposited onto the surface of the wager when the preparation surface next contacts the wafer. The deposited CMP byproducts can also cause irregularities in the surface of the wafer such as particle contamination, scratches, gouges and other irregularities. In view of the foregoing, there is a need for a system and method for efficiently and effectively reducing or removing the CMP byproduct build-up from the preparation surface.

SUMMARY OF THE INVENTION

Broadly speaking, the present invention fills these needs by providing an improved system and method for dispensing liquids to a CMP polishing pad. It should be appreciated that the present invention can be implemented in numerous ways, including as a process, an apparatus, a system, computer readable media, or a device. Several inventive embodiments of the present invention are described below.

On embodiment provides a method of delivering a liquid to a CMP polishing pad. The method includes supplying the liquid to a nozzle, the nozzle being oriented toward a polishing surface of the CMP polishing pad. The liquid flows at a rate of less than or equal to about 100 cc per minute. A pressurized carrier gas is also supplied to the nozzle. The liquid is substantially evenly sprayed from the nozzle onto the CMP polishing pad. The liquid can be a slurry or DIW or a cleaning solution or a rinsing solution.

A pressure of the pressurized carrier gas is not sufficient to atomize the liquid as the liquid is sprayed from the nozzle. The pressure of the pressurized carrier gas is within a range of about 1 to about 10 psi. The carrier gas can be air, CDA, or an inert gas.

Alternatively, the pressure of the pressurized carrier gas can be sufficient to atomize the liquid as the liquid is sprayed from the nozzle. The pressure of the pressurized carrier gas is within a range of about 10 to about 50 psi.

The nozzle can also include multiple nozzles. A flow rate and a pressure applied to at least one of the nozzles can be controlled independent from a flow rate and a pressure applied to the remaining nozzles of the plurality of nozzles.

Supplying the liquid into the nozzle can include sequentially supplying a first liquid and a second liquid into the nozzle. The first liquid can be a slurry and the second liquid can be a rinsing solution.

Another embodiment provides a method of rinsing a CMP polishing pad. The method includes supplying a rinsing solution and a pressurized carrier gas to a nozzle. A resulting spray from the nozzle being directed toward the CMP polishing pad. The spray having a force sufficient to substantially dislodge a CMP byproduct contaminant from the CMP polishing pad. Sufficient to substantially dislodge a CMP byproduct from the CMP polishing pad can include being sufficient to break an electrostatic bond between the CMP polishing pad and the byproduct contaminant. The pressurized includes injecting a carrier gas and injecting the liquid into a nozzle, the carrier gas can have a pressure of about 10 to about 50 psi.

Another embodiment provides a method of processing a wafer. The method includes applying a first slurry to a CMP polishing pad through a nozzle. A pressurized carrier gas is also supplied to the nozzle. A rinsing solution is applied through the nozzle and a second slurry is applied through the nozzle. The nozzle can include multiple nozzles.

Another embodiment provides a system for applying a liquid to a CMP polishing pad. The system includes a nozzle directed toward the CMP polishing pad. The nozzle having a first and a second input, the first input being coupled to a first supply, the second input being coupled to a carrier gas supply. The nozzle can include multiple nozzles mounted in a manifold. A flow rate and a pressure applied to at least one of the nozzles can be controlled independent from a flow rate and a pressure applied to the remaining nozzles.

The manifold includes a manifold body having at least one fluid supply bore constructed through the manifold body and at least one fluid supply port constructed along the manifold body to provide flow communication between the at least one fluid supply bore and an exterior of the manifold body. Each of the at least one fluid supply ports being configured to be fitted to one of the nozzles.

The system for applying a liquid to a CMP polishing pad can also include a controller and the controller can include a recipe. At least one valve for each of the nozzles can also be included. Each of the at least one valves being coupled to the controller can operate each of the at least one valves.

The present invention provides the advantage of using a reduced slurry flow rate while being able to evenly distribute the reduced slurry flow rate across the CMP polishing pad.

The present invention provides another advantage of effectively rinsing CMP polishing pad, thereby reducing the potential contaminants from the polishing pad being deposited on the substrate being processed.

Other aspects and advantages of the invention will become apparent from the following detailed description, taken in conjunction with the accompanying drawings, illustrated by way of example the principles of the invention.

BRIEF DESCRIPTION OF THE DRAWINGS

The present invention will be readily understood by the following detailed description in conjunction with the accompanying drawings, and like reference numerals designate like structural elements.

DETAILED DESCRIPTION OF THE EXEMPLARY EMBODIMENTS

Several exemplary embodiments for systems, methods and apparatus for applying liquid to a CMP polishing pad will now be described. It will be apparent to those skilled in the art that the present invention may be practiced without some or all of the specific details set forth herein.

Reducing the cost of semiconductor manufacturing processes is a constant goal in semiconductor manufacturing. The cost reductions can be in the form of a reduced cost manufacturing process tool or a more efficient use of the manufacturing process tool (e.g., increased throughput). Other methods of reducing costs of semiconductor manufacturing processes include such areas as reduced raw materials usage and cost, reduced quantity of waste streams, reduced production errors and other improvements.

As stated above, slurry and other process chemistries can be a costly portion of the operating cost of a CMP process tool. Therefore a CMP process tool that can perform similar results but with reduced use of process chemistries can reduce the cost of the CMP operations. One embodiment of the present invention includes an improved system and method for evenly applying a low slurry flow rates (e.g., about 100 cc/minute or less) to the preparation surface of a CMP polishing pad. A pressurized gas can be used to carry the slurry (or other process chemistries) through a distribution bar. The distribution bar can include one or more spray nozzles through which the carrier gas and slurry will spray toward the preparation surface of a CMP polishing pad. In this manner, the slurry (and other process chemistry) usage is significantly reduced, thereby reducing the operating cost. In the alternative, the improved dispensing system can enable more expensive slurries and process chemistries could be used without increasing the cost of the CMP operation.

Removing the CMP byproducts from the preparation surface is also necessary to reduce or eliminate irregularities and contamination caused by the CMP byproducts and to ensure a consistent CMP operation. One embodiment of the present invention includes a system and method of rinsing the preparation surface with a rinsing solution.

The rinsing solution is sprayed onto the preparation surface. A carrier gas can be used to increase the pressure of the rinsing solution so as to increase the mechanical force applied to the preparation surface by the rinsing solution. In this manner the CMP byproducts held deep within the pores of the preparation surface can be safely and effectively removed with a minimum quantity of rinsing solution. The rinsing solution and carrier gas combination can impart sufficient force to break electrostatic bonds that may develop between a CMP byproduct (i.e., particle) and the preparation surface.

Figure 1A:
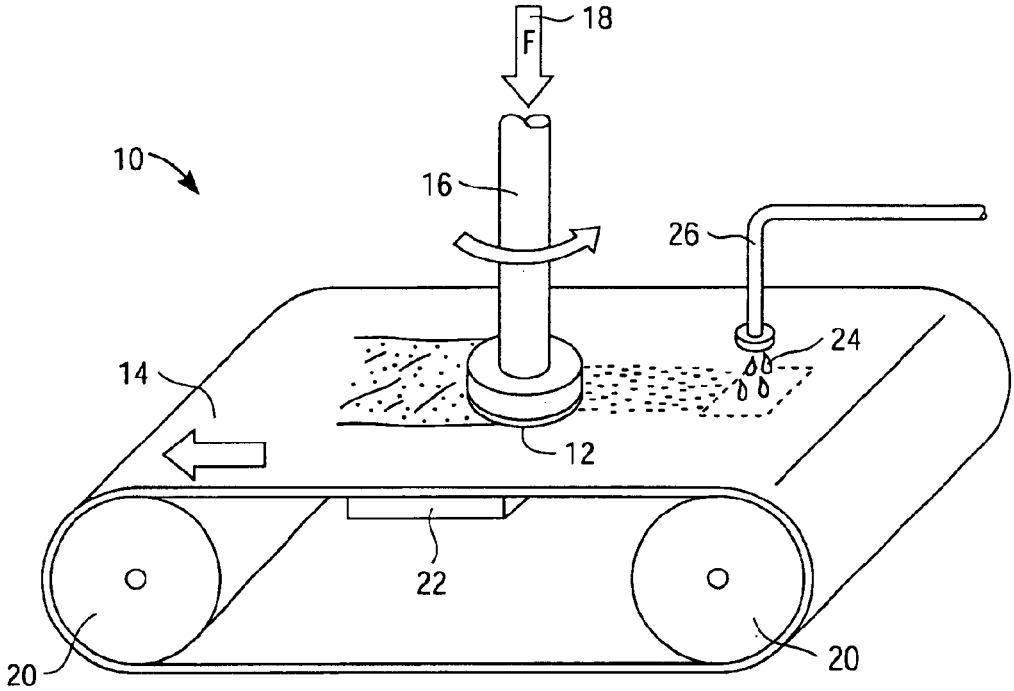
FIG. 1A (PRIOR ART)
FIG. 1A shows a typical linear belt CMP processing system.
Figure 1B:
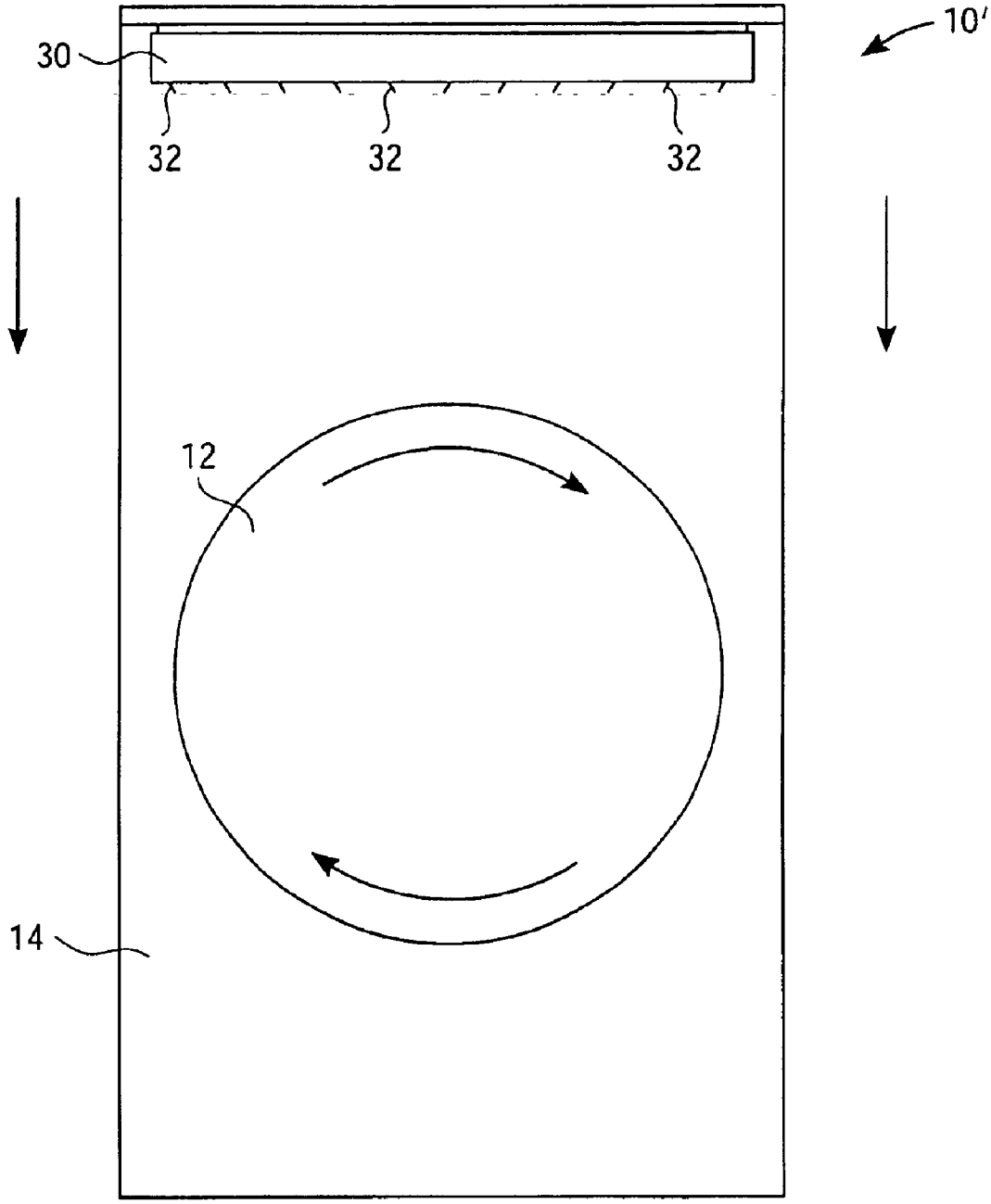
FIG. 1B shows an alternative slurry dispensing system.
Figure 2A:
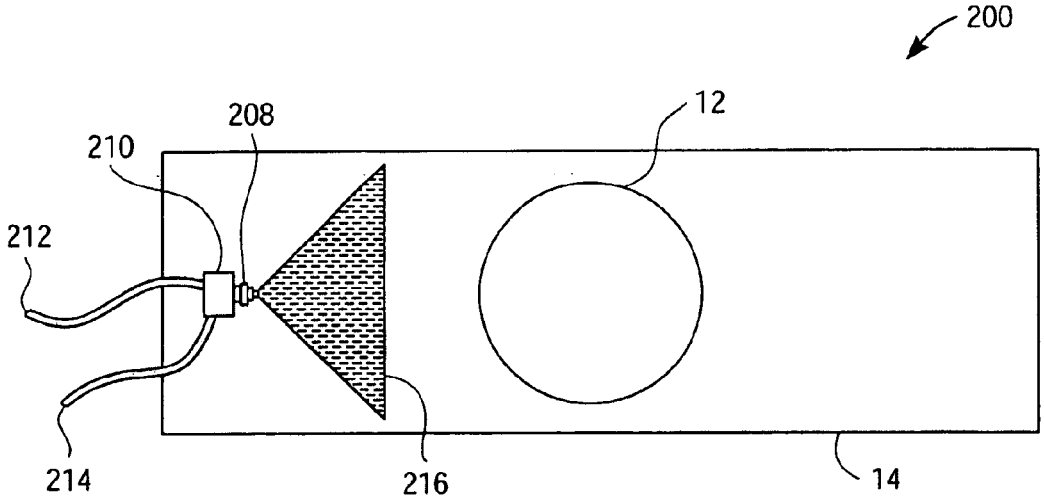
FIGS. 2A and 2B show an improved CMP apparatus in accordance with one embodiment of the present invention.
Figure 2B:
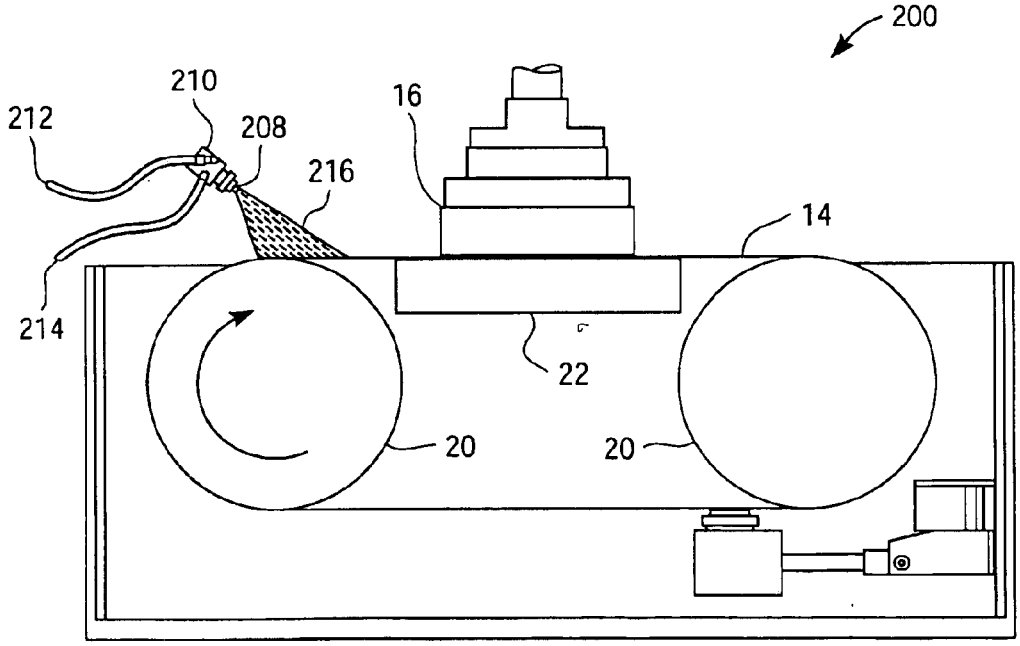

FIGS. 2A and 2B show an improved CMP apparatus 200 in accordance with one embodiment of the present invention. The CMP apparatus 200 includes an improved dispensing nozzle 208 that can apply a solution (e.g., slurry or other solution) onto the preparation surface of the CMP belt 14. The dispensing nozzle 208 applies the solution in a substantially uniform fan pattern 216. The fan pattern 216 evenly distributes the solution across the preparation surface of the CMP belt 14. The dispensing nozzle 208 is mounted in a dispensing manifold 210. The dispensing manifold 210 includes multiple inputs 212, 214. A first input 212 can supply the solution to the dispensing manifold 210. The second input 214 can supply a carrier gas to the dispensing manifold 210.

The carrier gas can be any one or more of any suitable carrier gases including CDA (compressed dry air), nitrogen, argon, or other suitable gases. The carrier gas can be an inert gas or a reactive gas that reacts with the solution or the CMP operation. The carrier gas can be a relatively low pressure of about 3 to about 5 psi, however higher or lower pressures could be used for different solutions and/or different flow rates of the solution. For example in a typical, aqueous slurry, the carrier gas is limited to about 5 psi or less so that the slurry is not significantly atomized.

The carrier gas is combined in the manifold 210 and/or nozzle 208 to carry the solution through the nozzle and into the substantially uniform fan pattern 216. Using the carrier gas to carry the solution through the nozzle 208 allows a very low flow rate of the solution (e.g., less than about 100 cc per minute) to be evenly distributed across the preparation surface of the CMP pad 14. While the carrier gas is used to enable low flow rates of the solution to be evenly distributed, flow rates of more than 100 cc per minute could also be delivered through the nozzle 208 with the carrier gas.

The nozzle 208 can be manufactured from any suitable material. An exemplary nozzle 208 is manufactured from PET (Polyethylene Terephthalate) however other materials such as nylon, plastic, ceramic, metal, composite and other materials can be used. The fan pattern 216 can have a fixed or a variable angle as determined by the shape of the nozzle selected for the particular solution and CMP operation.

While the improved dispensing nozzle 208 is described herein in terms of a belt type CMP process tool, it should be understood that the improved dispensing nozzle 208 could be used in any type of CMP process tool including circular (i.e., rotary), orbital, sub-aperture CMP processing tools, and other CMP processing tools. In alternative embodiments, the dispensing manifold 210 can include multiple dispensing nozzles 208.

Figure 3:
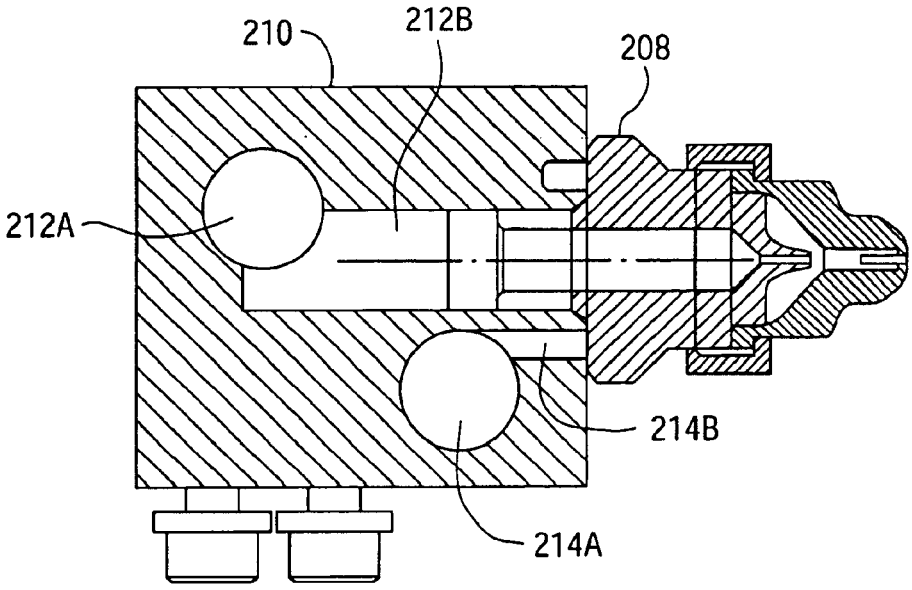
FIG. 3 is a detailed view of the dispensing manifold in accordance with one embodiment of the present invention.

FIG. 3 is a detailed view of the dispensing manifold 210 in accordance with one embodiment of the present invention. The manifold 210 includes a first bore 212A through which the solution is delivered to the nozzle 208. The manifold 210 also includes a second bore 214A through which the carrier gas is delivered to the nozzle 208. Corresponding ports 212B and 214B are formed in the manifold 210 to connect the nozzle 208 to the respective bores 212A, 214A.

Figure 4:
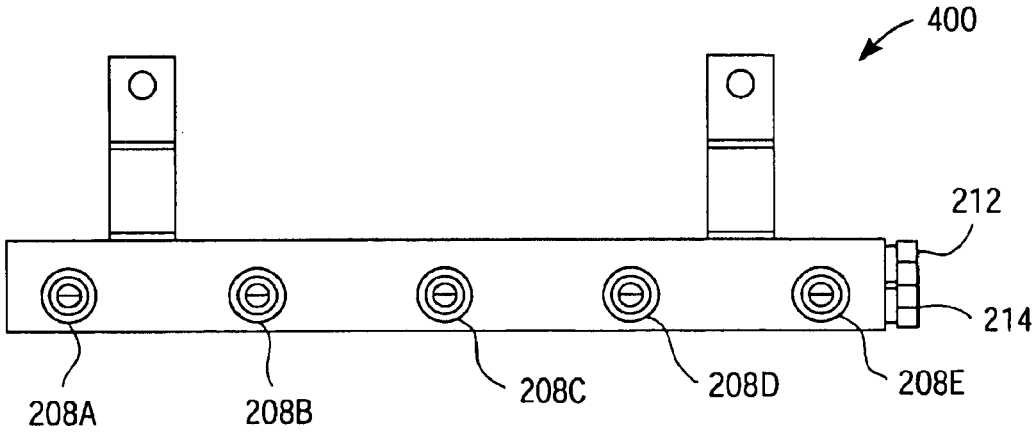
FIGS. 4–6 show an alternative manifold 400 in accordance with an embodiment of the present invention.
Figure 5:
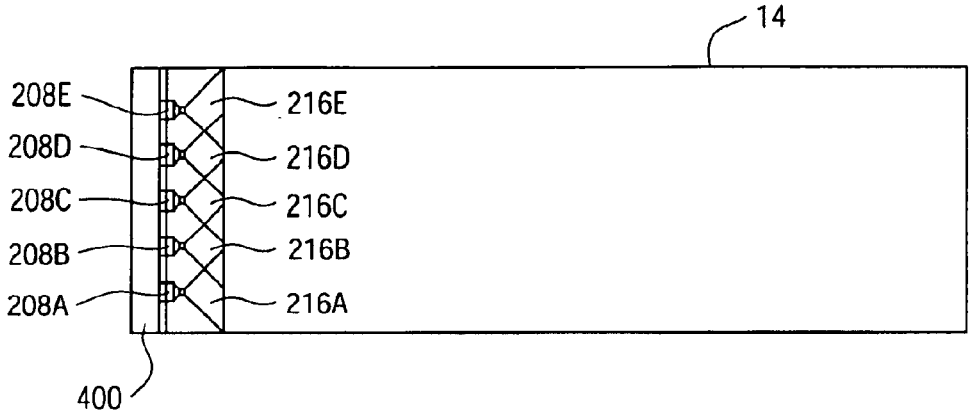
Figure 6:
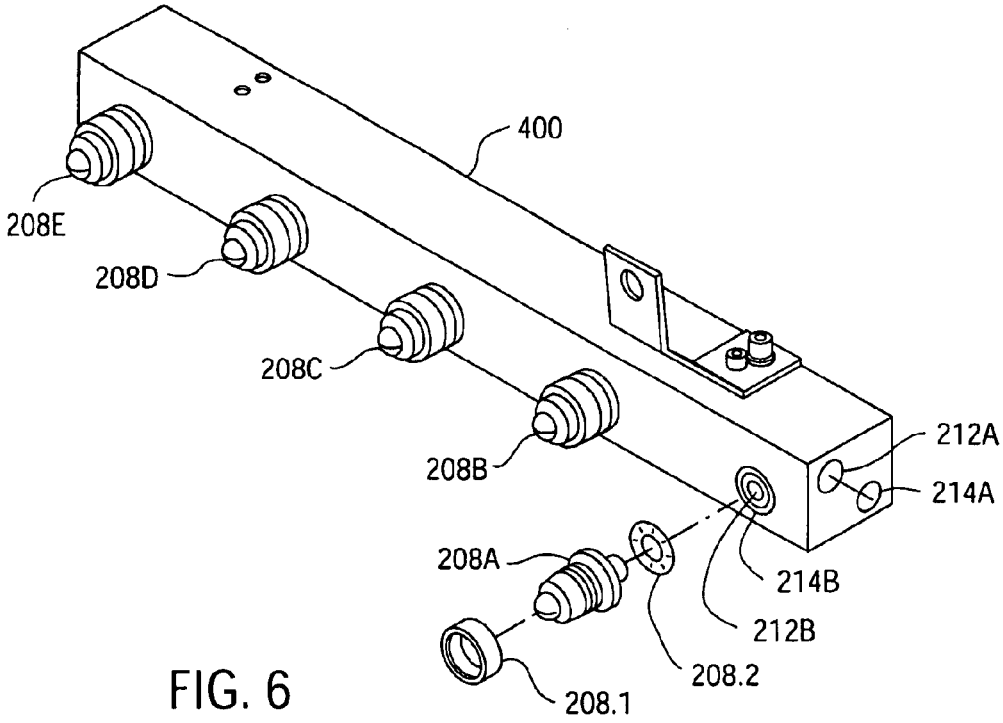

FIGS. 4–6 show an alternative manifold 400 in accordance with an embodiment of the present invention. The manifold 400 includes multiple nozzles 208A–E. Each of the multiple nozzles 208A–E can create a corresponding fan pattern 216A–E as shown in FIG. 5. The corresponding fan patterns 216A–E can be adjacent to one another or alternatively can overlap one another to provide the desired distribution across the preparation surface of the CMP belt 14. The manifold 400 can also include valves (not shown) that allow the selection of one or more of the nozzles 208A–208E. By way of example, the supply of solution and/or carrier gas to nozzle 208C could be disabled to control the flow to nozzle 208C.

FIG. 6 shows an isometric view of the alternative manifold 400 in accordance with an embodiment of the present invention. The nozzle 208A is shown removed from the bores 212A, 214A to illustrate the connection between the nozzle 208A and the bores 212A, 214A. Bore 214A is coupled to the nozzle 208A through a channel that is adjacent to and in one embodiment substantially surrounds bore 212A. The nozzle 208A can also utilize a gasket 208.2 and a nozzle ring 208.1. While the alternative manifold 400 is shown with only one row of nozzles, it should be understood that the multiple nozzles 208A–E could be arranged in more than one row.

Figure 7:
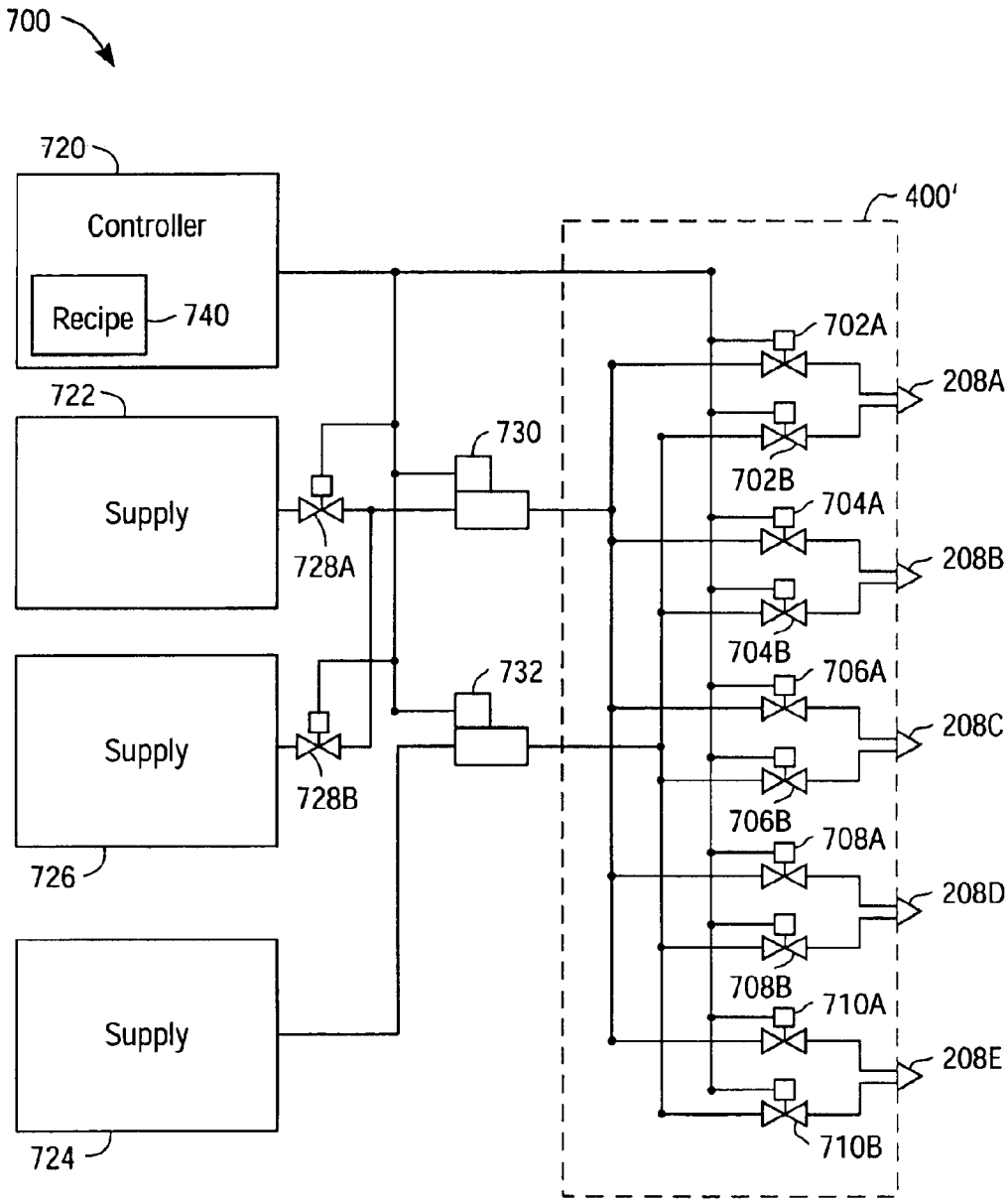
FIG. 7 is a schematic diagram the solution dispensing system including an alternative manifold in accordance with one embodiment of the present invention.

FIG. 7 is a schematic diagram the solution dispensing system 700 including an alternative manifold 400' in accordance with one embodiment of the present invention. The manifold 400' includes multiple nozzles 208A–E. A first supply source 722 supplies a solution to the manifold 400'. The solution can be a cleaning or rinsing or any other processing chemistry desired for the process. A second supply source 724 supplies a second input to the manifold 400'. The second input can be carrier gas source. In one embodiment, additional supply sources could also be included to supply one or more of the valves 208A–E exclusive of either or both of the first and second supply sources 722, 724.

Flow meters and/or flow controllers 730, 732 can also be included to monitor and control the respective flow rates of the first and second supply sources 722, 724. The flow controllers 730, 732 are coupled to a controller 720 that can monitor and control the flow controllers 730, 732. The controller 720 also includes a recipe 740 that includes the desired flow rates and other control parameters of the solution dispensing system 700. The controller 720 can also include outputs such as a display or other indicators that allow an operator to monitor the ongoing operations. The controller 720 can also include input devices such as a graphical user interface, keyboard, etc. so that an operator can manually manipulate the ongoing operations. The controller 720 can be included within a CMP system controller.

By way of example, the recipe 740 can specify a 50 cc per minute flow from the first supply 722 and 5 psi carrier gas flow for the second supply 724. The flow controllers 730, 732 can monitor and control the respective flows and pressures to ensure the appropriate flows and pressures are maintained. Data feedback from the flow controllers 730, 732 to the controller 720 can be used for closed loop control and so that the operator can monitor the ongoing operation.

The manifold 400' can also include one or more valves 702A–710B to control the flow to the corresponding nozzle 208A–E. Each of the valves 702A–710B is coupled to the system controller 720 so that the respective flows to the respective nozzles 208A–E can be selectively controlled by the controller 720. The valves 702A–710B can also include flow meters so that the flow to each nozzle can be precisely monitored and controlled by the controller 720.

By way of example, it may be desired that additional flow is applied to the center of the processing belt 14 and therefore the valve 706A may cause an increased flow from the first supply 722 to flow through the center nozzle 208C. A flow meter may be included or paired with valve 706A to provide feedback data to the controller 720. The controller 720 may also adjust the pressure and/or flow rate from valve 706B to maintain a pre-selected mixture set point.

A third (or even forth or more) supply 726 can also be included. Valves 728A and 728B provide the capability of switching between supply sources 722 and 726. Valves 728A and 728B can also be coupled to the controller 720 so that the controller can operate (i.e., open and close) the valves 728A and 728B. By way of example, for a first portion of the CMP operation slurry is supplied from the first supply source 722. During a subsequent portion of the CMP operation valve 728A is closed and valve 728B is opened to supply deionized water (DIW) from the third supply source 726. In this manner the solution being supplied can be changed during the CMP operation.

Figure 8:
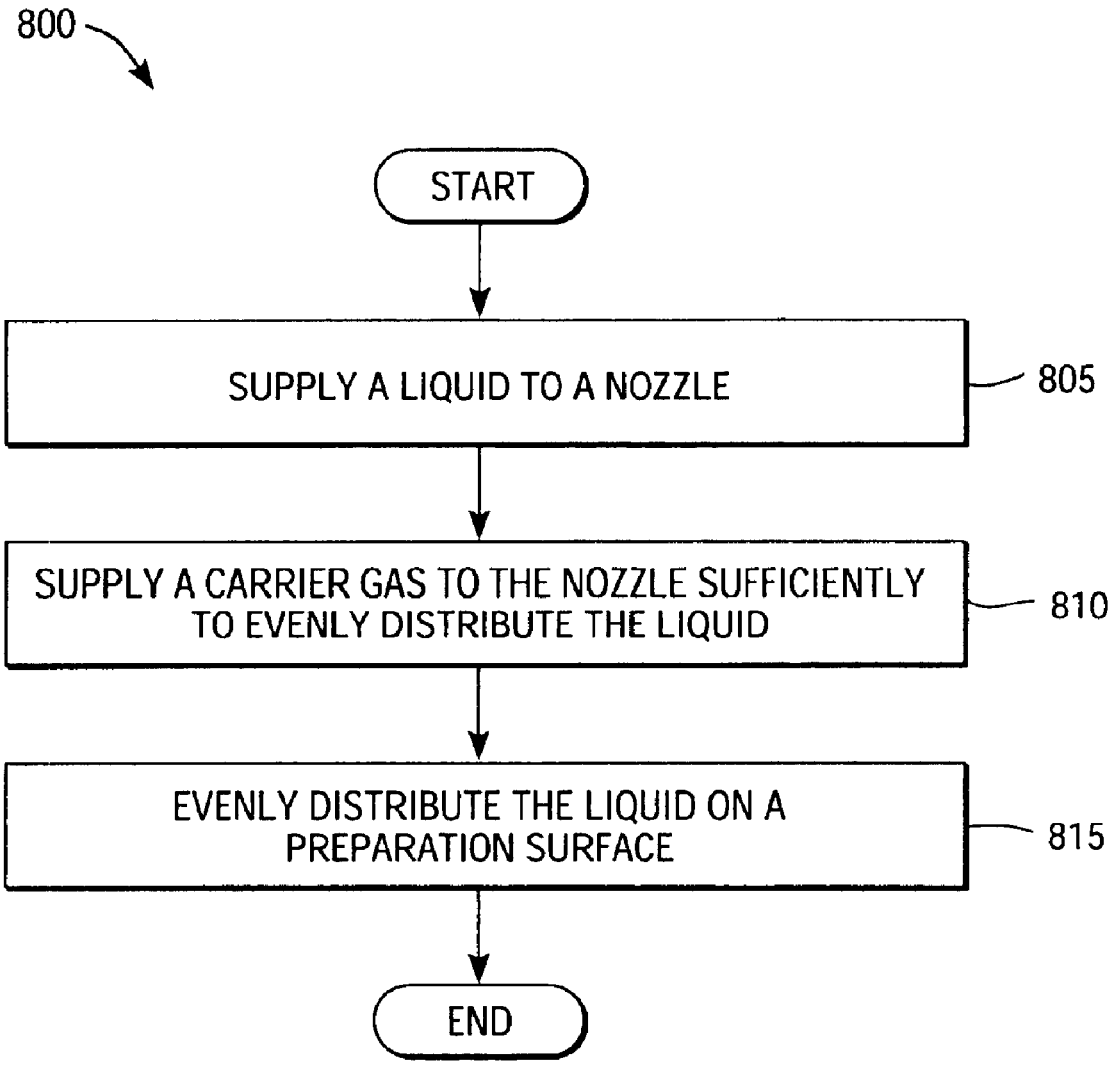
FIG. 8 is a flowchart of the method operations for applying a liquid in accordance with one embodiment of the present invention.

FIG. 8 is a flowchart of the method operations 800 for applying a liquid in accordance with one embodiment of the present invention. In an operation 805, a liquid is supplied to the nozzle such as slurry being supplied to the nozzle 208 as described above. Supplying the liquid to the nozzle can also include controlling the flow rate of the liquid to the nozzle such as with a valve or a flow meter and or a flow controller.

In an operation 810, a carrier gas is also supplied to the nozzle. As described above the carrier gas is supplied at a sufficient flow rate and pressure to provide the desired result. In one embodiment, the desired result may be to not atomize the liquid. As a result, the pressure will be limited so as to not atomize the liquid. The precise pressure will be a function of the type of liquid, the flow rate of the liquid, the nozzle design and the desired distribution pattern. By way of example a slurry may atomize if more than 8 psi of the carrier gas is applied where DIW may not atomize until 15 psi of the carrier gas is applied. Therefore when dispensing DIW water, the carrier gas pressure can be higher than when dispensing slurry.

In an operation 815, the mixture of the liquid and the carrier gas is output from the nozzle in a substantially uniform pattern. The liquid is thereby substantially evenly applied to the preparation surface as described above. In this manner a relatively low flow rate of the liquid can be evenly distributed (e.g., sprayed) across the preparation surface.

Figure 9:
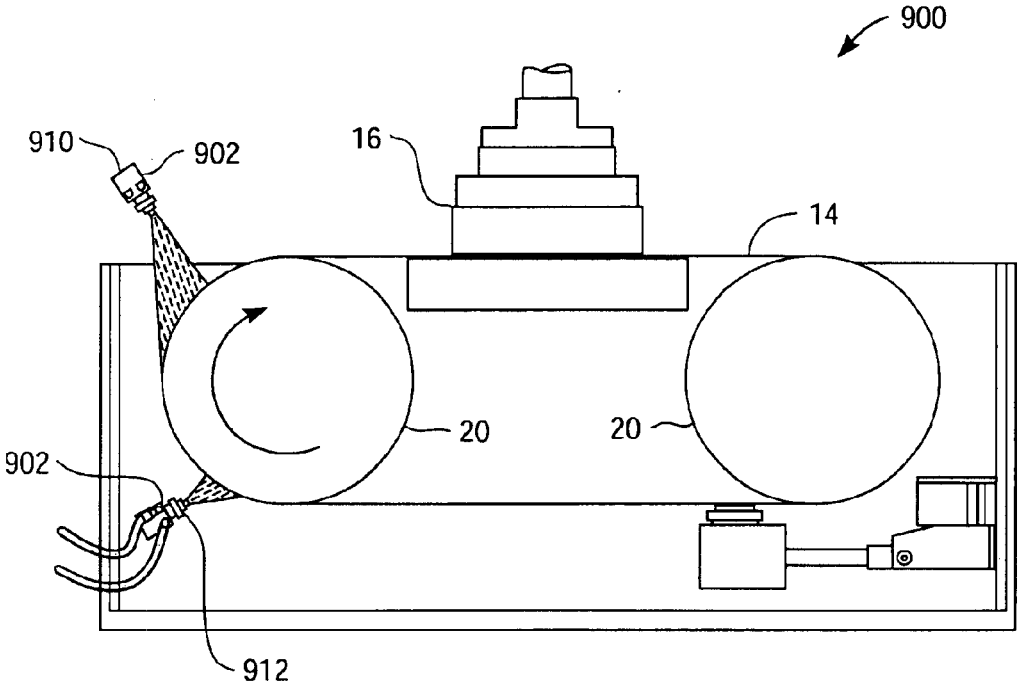
FIG. 9 shows a preparation surface cleaning system in accordance with one embodiment of the present invention.

FIG. 9 shows a preparation surface cleaning system 900 in accordance with one embodiment of the present invention. The preparation surface cleaning system 900 includes one or more nozzles 902 that are directed toward the preparation surface. The nozzles 902 can be located in one or more of positions 910, 912. The nozzles can spray a rinsing solution (e.g., DIW or other rinsing solution) onto the preparation surface with sufficient force to remove the CMP byproducts from the pores of the preparation surface. A carrier gas can be added to the rinsing solution to increase the force of the sprayed rinsing solution.

The nozzles 902 can include one or more nozzles substantially similar to those described in FIGS. 2A–8 above. The nozzles 902 can include multiple nozzles aligned side by side to provide rinsing coverage across the desired portion of the width of the preparation surface. The carrier gas pressure and the flow rate of the liquid rinsing solution can be substantially greater than that described-above for applying liquids to the preparation surface. By way of example, the rinsing solution can be DIW and the carrier gas pressure can be about 10 to about 50 psi or more. The nozzles 902 can also be controlled by the controller 720 in a manner similar to the nozzles 208A–E shown in FIGS. 2A–8 above.

Figure 10:
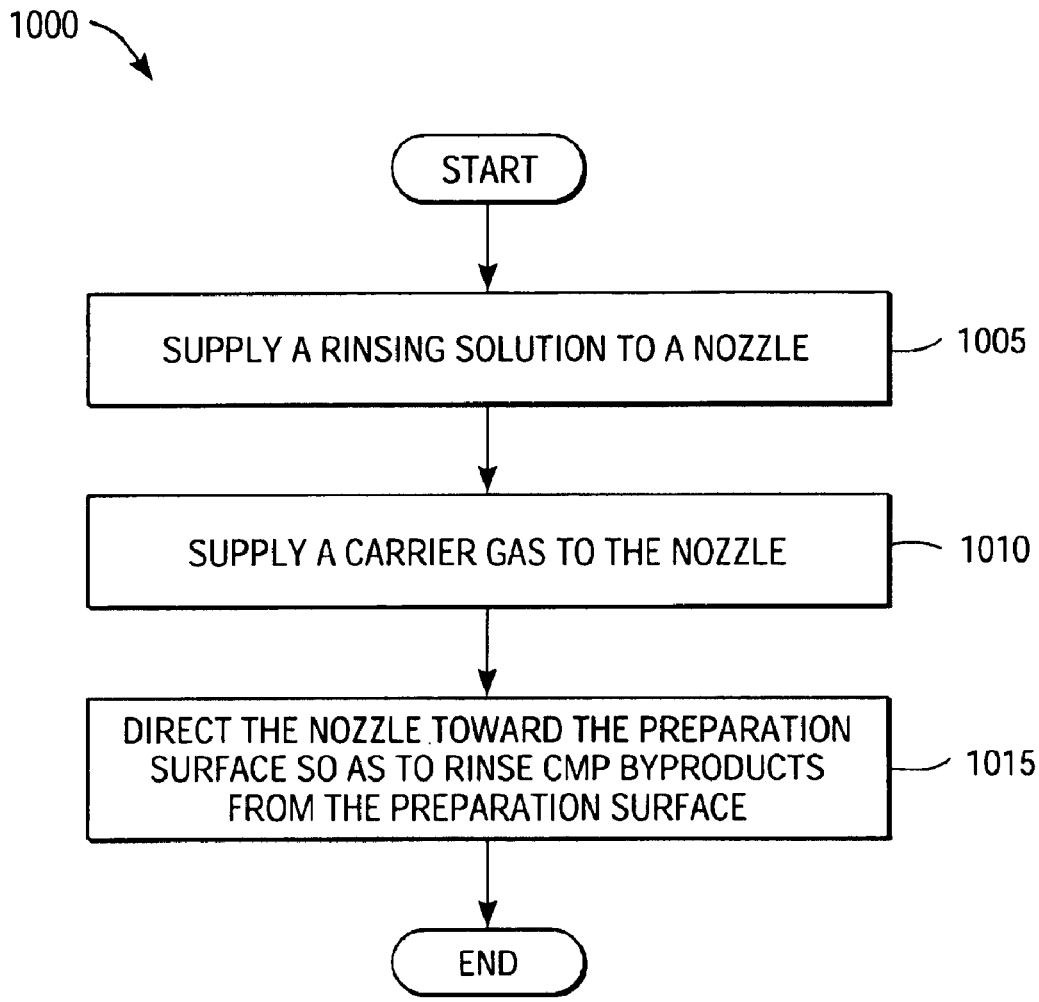
FIG. 10 is a flowchart of the method operations for rinsing a preparation surface in accordance with one embodiment of the present invention.

FIG. 10 is a flowchart of the method operations 1000 for rinsing a preparation surface in accordance with one embodiment of the present invention. In an operation 1005, a solution is supplied to a nozzle. The solution can be a rinsing solution such as DIW or other rinsing solutions capable of removing the CMP byproducts from the preparation surface. The solution can be selected that is chemically reactive such that might reduce the forces that cause the CMP byproduct to adhere to the preparation surface.

In an operation 1010, a carrier gas can be supplied to the nozzle. The carrier gas can be used to increase the pressure of the solution as it is sprayed out of the nozzle. The increased pressure can impart additional physical force to the preparation surface to better remove the CMP byproducts from the preparation surface.

In an operation 1015, the nozzle is oriented toward the preparation surface. The nozzle can be oriented at such an angle, such as shown in locations 910 and 912 of FIG. 9, where the solution is being sprayed from the nozzle at such an angle that the solution pushes the CMP byproducts against the direction of movement of the belt 14. In this manner, the CMP byproducts such as particles and other contaminants can be effectively removed from the preparation surface before the preparation surface passes the carrier 16.

In one embodiment, the improved dispensing system 200 can be combined with the rinsing system 900 so that a slurry (or other processing solution) can be dispensed evenly across the preparation surface before the preparation surface contacts the carrier 16 and wafer 12. The preparation surface is then rinsed after contacting the carrier 16 and wafer 12 to remove the CMP byproducts and then the process repeats as the belt 14 continues to cycle. In a similar manner the dispensing system 200 and the rinsing system 900 can be used in any other type of CMP process tool (e.g., circular, orbital, sub-aperture and other CMP process tools).

Any of the operations described herein that form part of the invention are useful machine operations. The invention also relates to a device or an apparatus for performing these operations. The apparatus may be specially constructed for the required purposes, or it may be a general-purpose computer selectively activated or configured by a computer program stored in the computer. In particular, various general-purpose machines may be used with computer programs written in accordance with the teachings herein, or it may be more convenient to construct a more specialized apparatus to perform the required operations.

The invention can also be embodied as computer readable code on a computer readable medium. The computer readable medium is any data storage device that can store data that can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

It will be further appreciated that the instructions represented by the operations in FIGS. 8 and 10 are not required to be performed in the order illustrated, and that all the processing represented by the operations may not be necessary to practice the invention. Further, the processes described in FIGS. 8 and 10 can also be implemented in software stored in any one of or combinations of the RAM, the ROM, or the hard disk drive.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method of delivering a liquid to a CMP polishing pad comprising:

supplying the liquid to a nozzle, the nozzle being oriented toward a polishing surface of the CMP polishing pad, wherein the liquid flows at a rate of less than or equal to about 100 cc per minute;

supplying a pressurized carrier gas to the nozzle simultaneous with the liquid;

substantially evenly spraying the liquid from the nozzle onto the CMP polishing pad.

2. The method of claim 1, wherein the liquid is a slurry.

3. The method of claim 1, wherein the liquid is DIW.

4. The method of claim 1, wherein the liquid is a cleaning solution.

5. The method of claim 1, wherein a pressure of the pressurized carrier gas is not sufficient to atomize the liquid as the liquid is sprayed from the nozzle.

6. The method of claim 1, wherein a pressure of the pressurized carrier gas is within a range of about 1 to about 10 psi.

7. The method of claim 1, wherein the carrier gas includes at least one of a group consisting of air, CDA, and an inert gas.

8. The method of claim 1, wherein a pressure of the pressurized carrier gas is sufficient to atomize the liquid as the liquid is sprayed from the nozzle.

9. The method of claim 8, wherein a pressure of the pressurized carrier gas is within a range of about 10 to about 50 psi.

10. The method of claim 1, wherein the nozzle includes a plurality of nozzles.

11. The method of claim 10, wherein a flow rate and a pressure applied to at least one of the plurality of nozzles can be controlled independent from a flow rate and a pressure applied to the remaining nozzles of the plurality of nozzles.

12. The method of claim 1, wherein supplying the liquid into a nozzle includes sequentially supplying a first liquid and a second liquid into the nozzle.

13. The method of claim 12, wherein the first liquid is a slurry and the second liquid is a rinsing solution.

14. A method of rinsing a CMP polishing pad comprising:

supplying a rinsing solution to a nozzle at a rate of less than or equal to about 100 cc per minute;

supplying a pressurized carrier gas to the nozzle simultaneous with the rinsing solution;

directing a resulting spray from the nozzle toward the CMP polishing pad, the spray having a force sufficient to substantially dislodge a CMP byproduct contaminant from the CMP polishing pad.

15. The method of claim 14, wherein sufficient to substantially dislodge a CMP byproduct from the CMP polishing pad includes sufficient to break an electrostatic bond between the CMP polishing pad and the byproduct contaminant.

16. The method of claim 14, wherein the carrier gas has a pressure of about 10–50 psi.

17. A method of processing a wafer comprising:

applying a first slurry to a CMP polishing pad through a nozzle at a rate of less than or equal to about 100 cc per minute, wherein a pressurized carrier gas is also supplied to the nozzle;

applying a rinsing solution through the nozzle; and applying a second slurry through the nozzle.

18. The method of claim 17, wherein the nozzle include a plurality of nozzles.

19. A system for applying a liquid to a CMP polishing pad comprising:

a nozzle directed toward the CMP polishing pad, the nozzle having a first and a second input, the first input being coupled to a first supply, the second input being coupled to a carrier gas supply, wherein the first supply and the carrier gas supply are supplied to the nozzle simultaneously and wherein the first supply is supplied at a rate of less than or equal to about 100 cc per minute.

20. The system of claim 19, wherein the nozzle includes a plurality of nozzles mounted in a manifold.

21. The system of claim 20, wherein a flow rate and a pressure applied to at least one of the plurality of nozzles can be controlled independent from a flow rate and a pressure applied to the remaining nozzles of the plurality of nozzles.

22. The system of claim 20, wherein the manifold includes:

a manifold body having at least one fluid supply bore constructed through the manifold body; and at least one fluid supply port constructed along the manifold body to provide flow communication between the at least one fluid supply bore and an exterior of the manifold body, each of the at least one fluid supply ports being configured to be fitted to one of the plurity of nozzles.

23. The system of claim 20, further comprising:

a controller including a recipe; and at least one valve for each of the plurality of nozzles, each of the at least one valves being coupled to the controller so that the controller can operate each of the at least one valves.

* * * * *